US009993918B2

(12) United States Patent
Mathews, Jr.

(10) Patent No.: US 9,993,918 B2
(45) Date of Patent: Jun. 12, 2018

(54) TOOL CONTAINER ASSEMBLY

(71) Applicant: D B Industries, LLC, Red Wing, MN (US)

(72) Inventor: William J. Mathews, Jr., Woodstock, GA (US)

(73) Assignee: D B INDUSTRIES, LLC, Maplewood, MN (US)

( * ) Notice: Subject to any disclaimer, the term of this patent is extended or adjusted under 35 U.S.C. 154(b) by 123 days.

(21) Appl. No.: 14/858,338

(22) Filed: Sep. 18, 2015

(65) Prior Publication Data

US 2016/0082585 A1 Mar. 24, 2016

Related U.S. Application Data

(60) Provisional application No. 62/053,422, filed on Sep. 22, 2014, provisional application No. 62/101,481, filed on Jan. 9, 2015.

(51) Int. Cl.

| | |
|---|---|
| ***B65D 85/28*** | (2006.01) |
| ***B25H 3/02*** | (2006.01) |
| ***B65D 25/28*** | (2006.01) |
| ***B25H 3/00*** | (2006.01) |

(52) U.S. Cl.

CPC ..... *B25H 3/02* (2013.01); *B25H 3/00* (2013.01); *B65D 25/2867* (2013.01)

(58) Field of Classification Search

CPC ..... B25H 3/02; B25H 3/00; B65D 25/2867; B65D 79/02; B65D 2203/00; B65D 55/026

USPC ..... 206/372, 373, 388, 702, 349, 459.1, 206/459.5; 383/26, 210; 292/325, 251.5

See application file for complete search history.

(56) References Cited

U.S. PATENT DOCUMENTS 4,403,638 A * 9/1983 Baum ..... A45C 7/0086 206/316.2
4,688,674 A * 8/1987 Stirtz ..... B65H 75/362 206/388
4,887,751 A 12/1989 Lehman
5,653,337 A * 8/1997 Cirigliano ..... A45C 3/00 206/373

(Continued)

FOREIGN PATENT DOCUMENTS

DE 10018607 A1 10/2001

OTHER PUBLICATIONS

Python Safety, Fall Protection for Tools®, Winter / Spring 2014 Product Catalog, on sale prior to Sep. 22, 2014, 4 pages.

(Continued)

*Primary Examiner* — J. Gregory Pickett
*Assistant Examiner* — Rafael Ortiz

(57) ABSTRACT

A tool container assembly comprises a body, an extension portion, and a fastening member. The body has a bottom, a side, and a top providing access to a cavity formed by the bottom and the side. The extension portion is operatively connected to the top, and the extension portion has a distal end portion. The fastening member is operatively connected to the distal end portion, and the fastening member has an open position and a closed position. The open position forms an opening allowing access to the cavity, and the closed position closes the opening thereby preventing access to the cavity. The closed position includes an easy opening position and a difficult opening position.

19 Claims, 10 Drawing Sheets

(56) References Cited

U.S. PATENT DOCUMENTS

| | | | | |
|---|---|---|---|---|
| 2004/0016666 | A1 | 1/2004 | Redzisz | |
| 2005/0045640 | A1 | 3/2005 | Waring | |
| 2005/0211586 | A1 | 9/2005 | Fierek | |
| 2008/0169739 | A1* | 7/2008 | Goldenberg | B25H 3/04 312/244 |
| 2008/0197756 | A1 | 8/2008 | Macias et al. | |
| 2009/0250470 | A1* | 10/2009 | Merrick | B25H 3/00 220/495.06 |
| 2014/0353191 | A1* | 12/2014 | DeCicco | B25H 3/022 206/373 |

OTHER PUBLICATIONS

International Search Report issued in International Application No. PCT/US2015/051176, filed Sep. 21, 2015.

* cited by examiner

TOOL CONTAINER ASSEMBLY

CROSS-REFERENCE TO RELATED APPLICATIONS

This application claims the benefit of U.S. Provisional Application Ser. No. 62/053,422, filed Sep. 22, 2014 and U.S. Provisional Application Ser. No. 62/101,481, filed Jan. 9, 2015, which are incorporated in their entirety herein by reference.

BACKGROUND OF THE INVENTION

Dropped objects such as tools and small parts could be hazardous on work sites, especially where workers are performing tasks at heights and other workers are positioned below them. Many workers use tool containers such as buckets or bags to transport a variety of tools, small parts, and other items to work sites. Commonly, the buckets or bags are lifted using ropes to the work sites. However, this presents a problem of potential tipping during the lifting process should the buckets or bags be top loaded or should they become snagged on structures thereby spilling the contents. Existing closure assemblies are difficult to operate and, therefore, workers tend to not use the closure assemblies. In addition, workers tend to leave tools, small parts, and other items laying on platforms, equipment, and other surfaces when not in use. This also presents a problem when the tools or small parts are accidentally bumped or otherwise moved because they could fall and injure workers positioned below the work sites.

For the reasons stated above and for other reasons stated below, which will become apparent to those skilled in the art upon reading and understanding the present specification, there is a need in the art for easy to operate closure assemblies for buckets or bags to prevent tools, small parts, and other items from falling out of buckets or bags during transport and for tether assemblies to prevent dropping of tools, small parts, and other items.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a tool container assembly comprises a body, an extension portion, and a fastening member. The body has a bottom, a side, and a top providing access to a cavity formed by the bottom and the side. The extension portion is operatively connected to the top, and the extension portion has a distal end portion. The fastening member is operatively connected to the distal end portion, and the fastening member has an open position and a closed position. The open position forms an opening allowing access to the cavity, and the closed position closes the opening thereby preventing access to the cavity.

In one embodiment, the closed position includes an easy opening position and a difficult opening position.

In one embodiment, a tool container assembly comprises a body, an extension portion, a fastening member, handles, and indicators. The body has a bottom, a side, and a top providing access to a cavity formed by the bottom and the side. The extension portion is operatively connected to the top, and the extension portion has a distal end portion. The fastening member is operatively connected to the distal end portion, and the fastening member has an open position and a closed position. The open position forms an opening allowing access to the cavity, and the closed position closes the opening thereby preventing access to the cavity. A first handle and a second handle are operatively connected to opposing sides of the distal end portion of the extension portion. First and third indicators are positioned on one side and second and fourth indicators are positioned on another side of the distal end portion. The first and second indicators are at least partially aligned to at least partially align the first and second handles and position the extension portion in an easy opening position, and the third and fourth indicators are at least partially aligned to offset the first and second handles and position the extension portion in a difficult opening position.

In one embodiment, a tool container assembly comprises a body, an extension portion, and a fastening member. The body has a bottom, a side, and a top providing access to a cavity formed by the bottom and the side. The extension portion is operatively connected to the top, and the extension portion has a distal end portion. The fastening member is operatively connected to the distal end portion, and the fastening member has an open position and a closed position. The open position forms an opening allowing access to the cavity, and the closed position closes the opening thereby preventing access to the cavity. The fastening member includes a drawstring and an engaging member. Friction between the engaging member and the drawstring assists in keeping the drawstring in a desired position and allows the drawstring to move through the engaging member when a force is exerted on the drawstring.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

Figure 2:
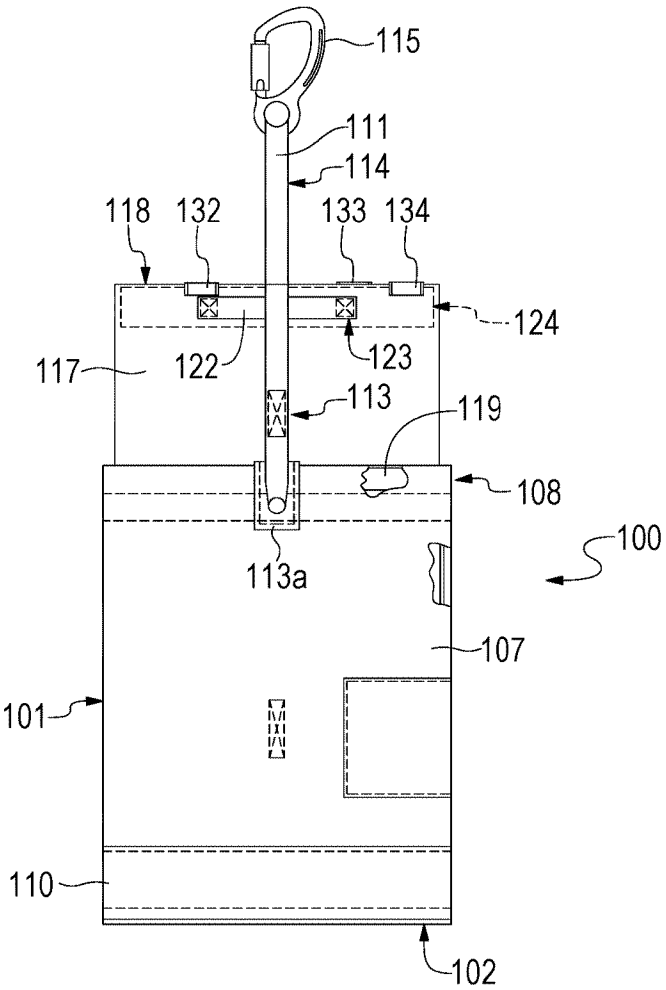
FIG. 2 is a side view of the tool container assembly shown in FIG. 1.
Figure 1:
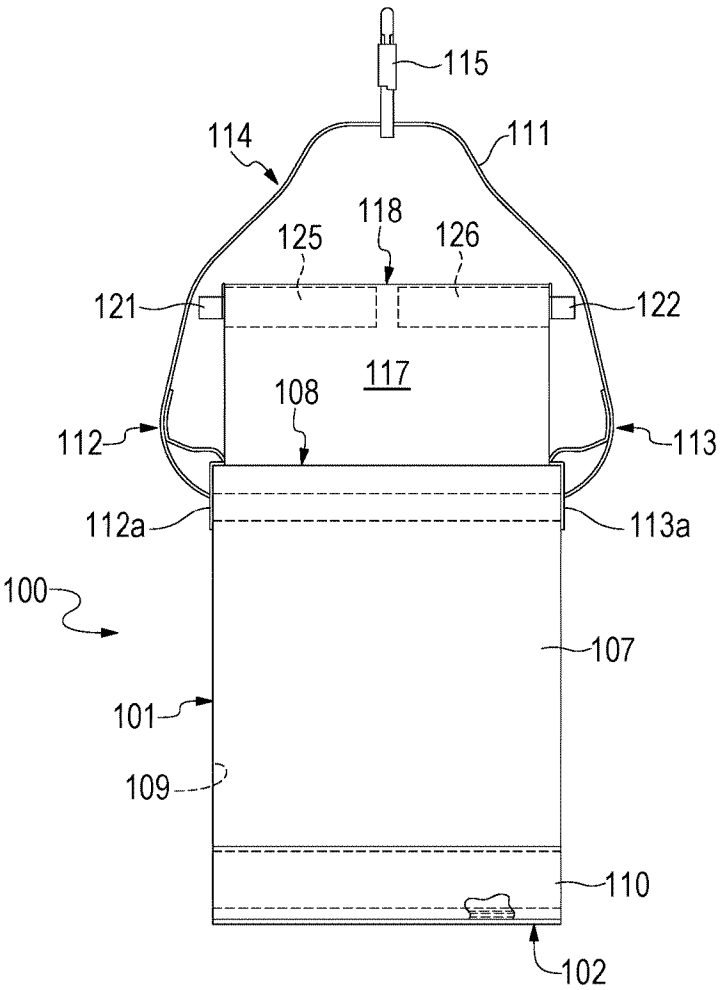
FIG. 1 is a front view of a tool container assembly constructed in accordance with the principles of the present invention.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention generally provide a tool container assembly comprising a body, an extension portion, and a fastening member. The body has a bottom, a side, and a top providing access to a cavity formed by the bottom and the side. The extension portion is operatively connected to the top, and the extension portion has a distal end portion. The extension portion and the fastening member are part of the closure assembly. The fastening member is operatively connected to the distal end portion, and the fastening member has an open position and a closed position. The open position forms an opening allowing access to the cavity, and the closed position closes the opening thereby preventing access to the cavity. The closed position includes an easy opening position and a difficult opening position. The fastening member could be any suitable fastener from the group consisting of a hook and loop fastener, a plurality of snaps, a drawstring, a buckle, and other suitable fasteners.

In addition, embodiments of the present invention generally optionally provide a tether assembly configured and arranged to interconnect tools, small parts, and other items to the tool container assembly. Further, embodiments of the present invention generally also optionally provide an insert configured and arranged to provide additional storage and organization options.

In one embodiment, shown in FIGS. 1-10, a tool container assembly 100 includes a body 101 having a bottom 102, a side 107, and a top 108. The bottom 102, the side 107, and the top 108 form a cavity 109 accessible through an opening formed by the top 108. A rim 119 is operatively connected to the top 108 to assist in providing structure to the top 108 and its opening. An extension portion 117, which is a sleeve-like extension of the side 107, is operatively connected to the top 108 and includes a distal end portion 118. A bottom support 110 could be used to interconnect the bottom 102 and the side 107 and could be used to add strength proximate the bottom of the assembly.

Figure 10:
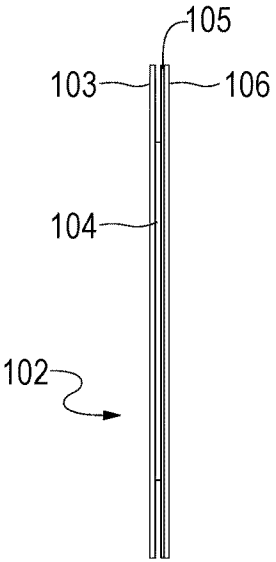
FIG. 10 is a cross-section taken along the lines 10-10 in FIG. 9 with the bottom layers unstitched and unfolded.
Figure 9:
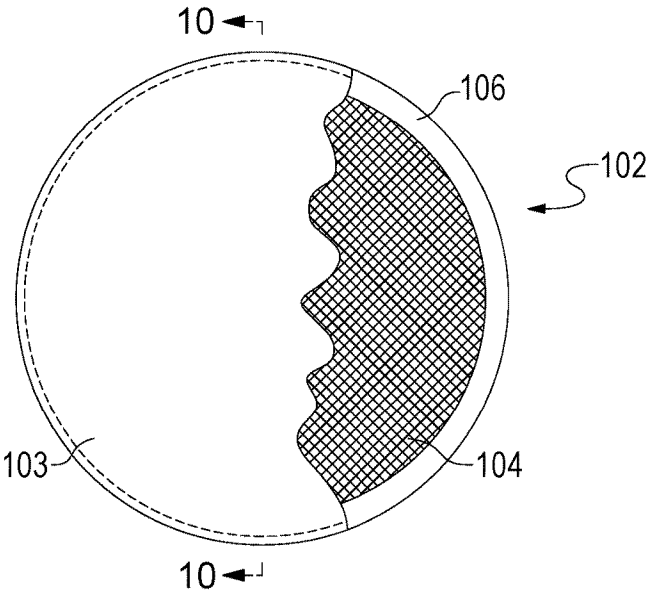
FIG. 9 is a bottom view with a portion cutaway of the tool container assembly shown in FIG. 1.

The bottom 102 includes a first layer 103 preferably made of tarpaulin, a second layer 104 preferably made of hardboard, a third layer 105 preferably made of tarpaulin, and a fourth layer 106 preferably made of PVC leather. The bottom support 110 could include an inside layer 110*a* made of tarpaulin and an outside layer 110*b* made of tarpaulin. The bottom 102 is shown in FIGS. 9 and 10. In FIG. 9, the first, third, and fourth layers 103, 105, and 106 are folded and stitched thereby hiding the third layer 105, and in FIG. 10, the first, third, and fourth layers 103, 105, and 106 are unstitched and unfolded. The side 107, the top 108, and the extension portion 117 are preferably made of canvas. The rim 119 is preferably positioned in the top hem of the side 107, and could be any suitable material such as but not limited to molded plastic, nylon pipe material, steel, or wood approximately one inch wide, which makes the top of the container relatively stiff. It is recognized that fewer or more layers made of different materials could be used for any of these components in accordance with desired durability.

An elongate member 111 preferably made of webbing or rope includes an intermediate portion 114 interconnecting a first end 112 and a second end 113. Proximate one side of the side 107, a first reinforcing member 112*a* may be operatively connected to the side 107 proximate the top 108, and proximate an opposing side of the side 107, a second reinforcing member 113*a* may be operatively connected to the side 107 proximate the top 108. The reinforcing members 112*a* and 113*a* provide stronger areas to which the ends 112 and 113 are connected. For example, the reinforcing members 112*a* and 113*a* may be made of a stronger material, such as leather, and include apertures through which the respective ends 112 and 113 are inserted and then secured onto themselves, preferably by stitching or any other suitable securing member, forming loops through which the rim 119 extends. A connector 115, for example a carabiner, may be connected to the intermediate portion 114 to provide a way to connect the assembly to a hoist line, an anchorage structure, or the like.

Figure 5:
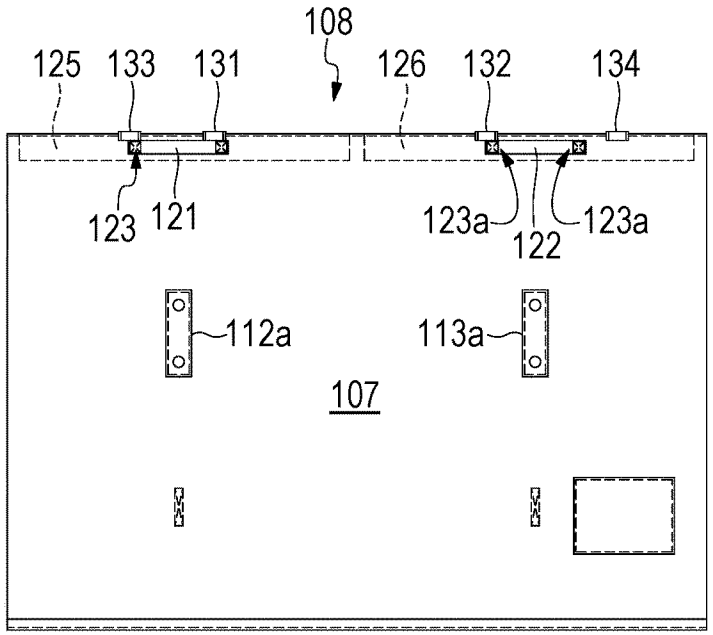
FIG. 5 is a plan view of an outside surface of the side shown in FIG. 3.
Figure 4:
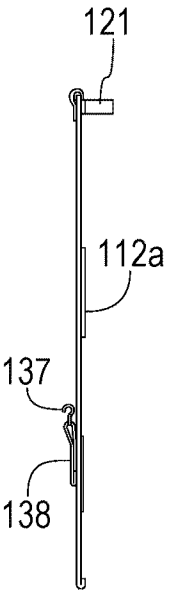
FIG. 4 is a side view of the side shown in FIG. 3.
Figure 3:
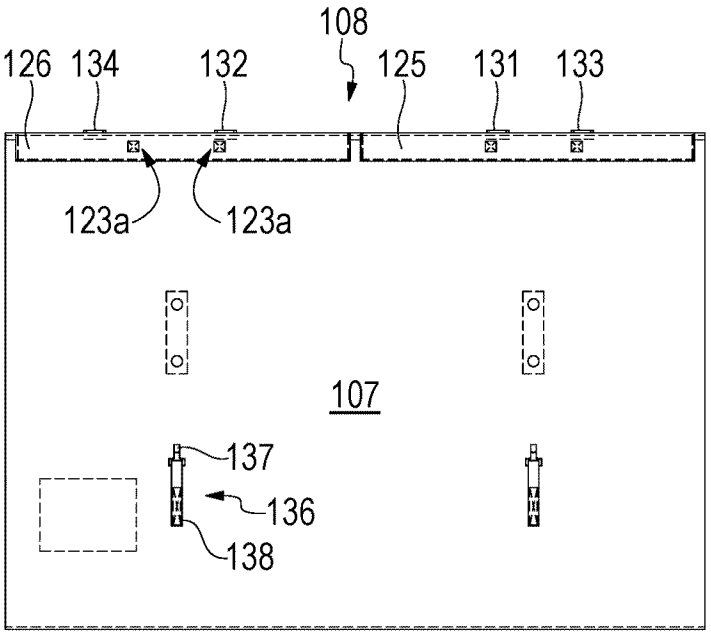
FIG. 3 is a plan view of an inside surface of a side of the tool container assembly shown in FIG. 1.
Figure 8:
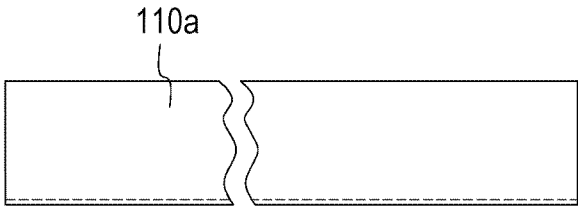
FIG. 8 is a plan view of an inside surface of the bottom support shown in FIG. 6.
Figure 7:
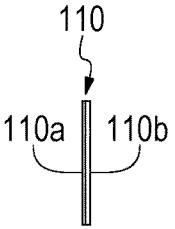
FIG. 7 is a side view of the bottom support shown in FIG. 6.
Figure 6:
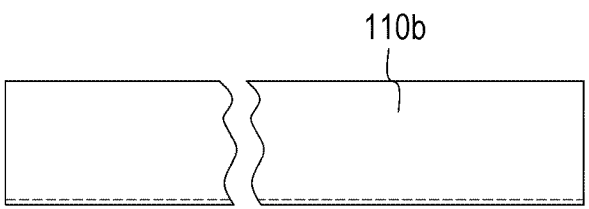
FIG. 6 is a plan view of an outside surface of a bottom support of the tool container assembly shown in FIG. 1.

A first handle 121 is operatively connected to a first outer side of the distal end portion 118, and a second handle 122 is operatively connected to a second, generally opposing outer side of the distal end portion 118. The handles 121 and 122 are connected to the respective sides with handle attachments 123, in this embodiment box-X stitch patterns, having inner sides 123*a* relative to the handles, as shown in FIGS. 3 and 5. The handles 121 and 122 or the elongate member 111 could be used to carry the assembly. A fastening member 124 interconnects first and second inner sides of the distal end portion 118. In this embodiment, a loop portion 125 is operatively connected to one inner side and a hook portion 126 is operatively connected to a generally opposing inner side.

The distal end portion 118 forms an opening, which may be positioned in an open position or a closed position (not shown in this embodiment). In the open position, the opening provides access to the cavity 109. In the closed position, the opening is generally closed by the fastening member 124 thereby preventing access to the cavity 109. There are two closed positions, an easy opening position and a difficult opening position. The two closed positions are described in more detail in a similar embodiment, tool container assembly 100'.

The distal end portion 118 also includes indicators, which assist in positioning the distal end portion 118 in the desired closed position. Generally, a first pair of indicators are aligned for the easy opening position and a second pair of indicators are aligned for the difficult opening position. For example, in this embodiment, a first indicator 131 is proximate a first end of the first handle 121, a second indicator 132 is proximate a first end of the second handle 122, a third indicator 133 is proximate a second end of the first handle 121, and a fourth indicator 134 is positioned a distance away from a second end of the second handle 122. It is recognized that other suitable types of indicators could be used.

An optional attachment member 136 includes an engaging portion 137, which is preferably a ring or a hook to which any suitable tool lanyard may be connected, and a strap 138, which is preferably nylon webbing or an elastic material and interconnects the engaging portion 137 and the body 101, preferably the inside surface of the side 107. The attachment member 136 is shown in FIG. 3.

Figure 11:
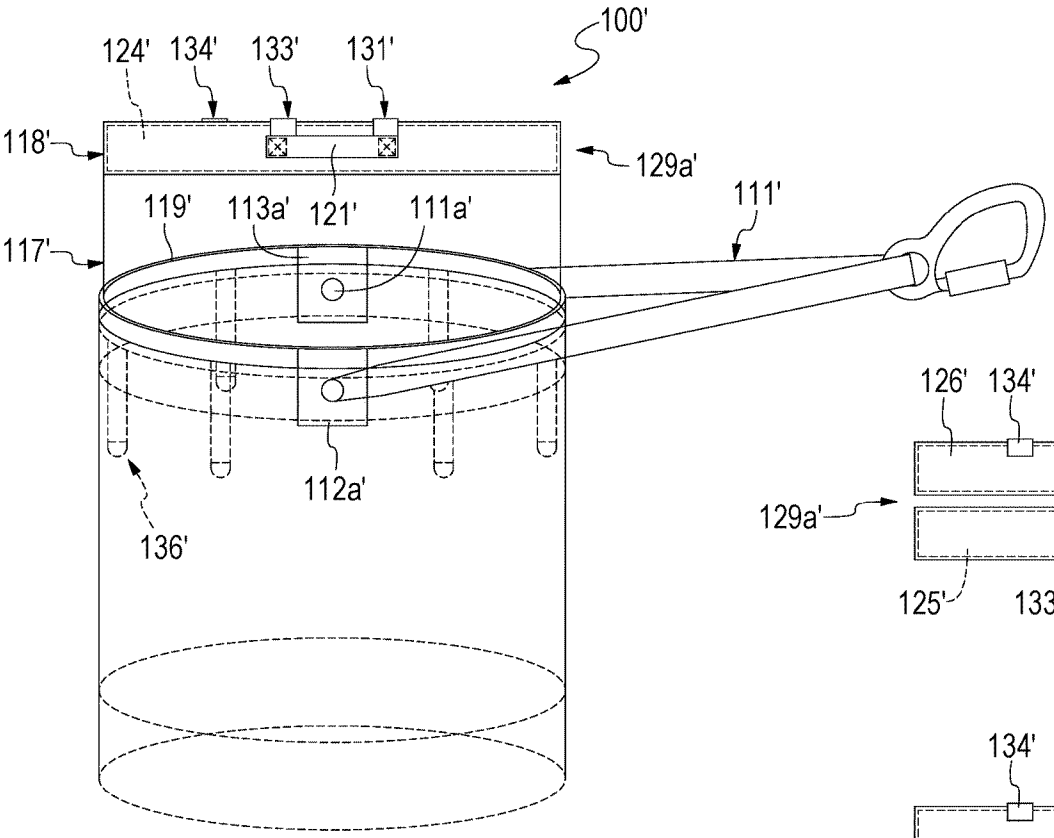
FIG. 11 is a front view of another embodiment tool container assembly constructed in accordance with the principles of the present invention.

In a similar embodiment, tool container assembly 100' shown in FIG. 11, the closure assembly and additional features are described, but substantially similar features to the tool container assembly 100 are not described.

The elongate member 111' could be a cord or rope with a knot or stop 111*a*' proximate each end preventing the ends from sliding through the respective apertures in the reinforcement members 112*a*' and 113*a*', preferably positioned below the rim 119'.

Figure 20:
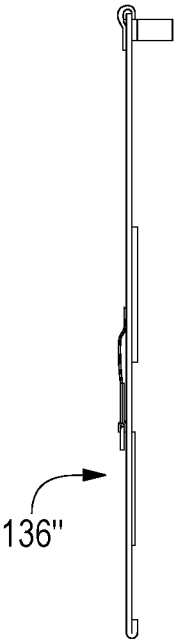
FIG. 20 is a side view of the side shown in FIG. 19.
Figure 19:
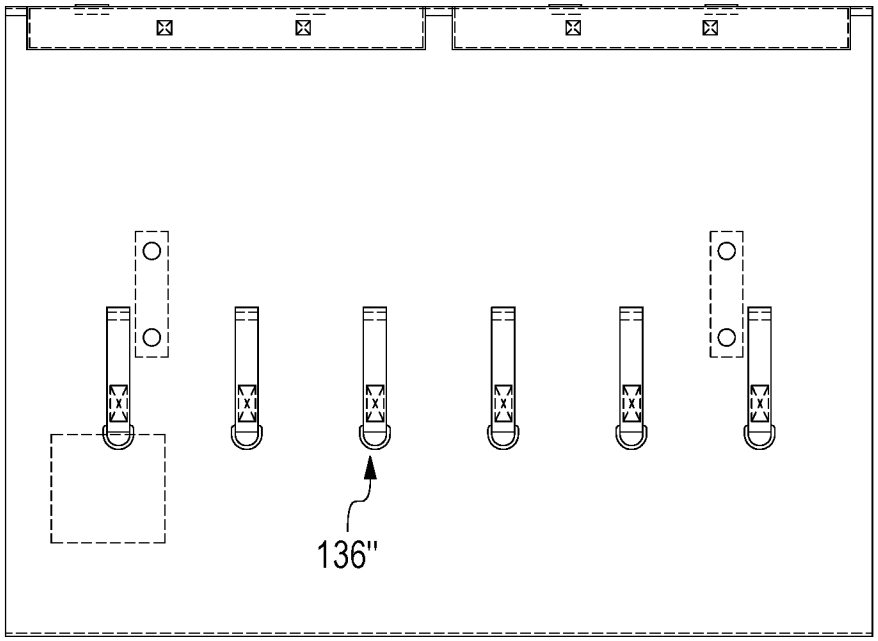
FIG. 19 is a plan view of an inside surface of a side of another embodiment tool container assembly constructed in accordance with the principles of the present invention.
Figure 23:
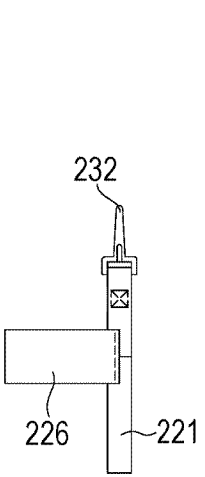
FIG. 23 is a front view of portions of a fastening member and a locking member of the tool container assembly shown in FIG. 21.

The optional attachment member 136' includes an engaging portion, which is preferably a ring or a hook to which any suitable tool lanyard may be connected, and a strap, which is preferably nylon webbing or an elastic material and interconnects the engaging portion and the body, preferably the inside surface of the side. The attachment member 136' is shown in FIG. 11 and extends generally downward rather than upward as the attachment member 136. Another embodiment attachment member 136" is shown in FIGS. 19 and 20.

Figure 12:
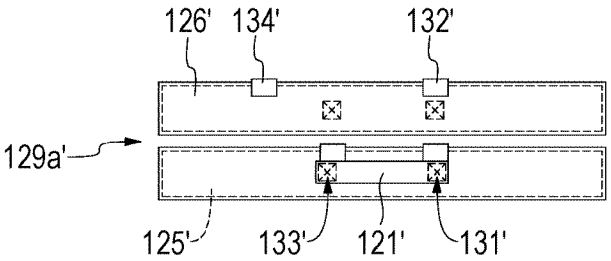
FIG. 12 is a plan view of a top portion of the tool container assembly shown in FIG. 11 showing a first alignment position.
Figure 13:
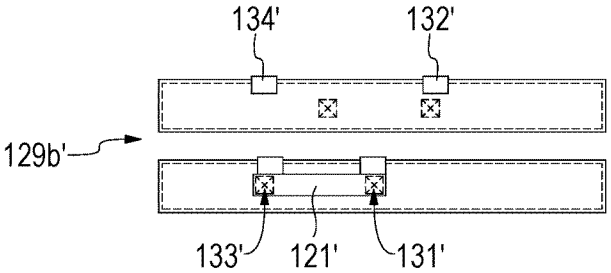
FIG. 13 is a plan view of the top portion of the tool container assembly shown in FIG. 11 showing a second alignment position.
Figure 14:
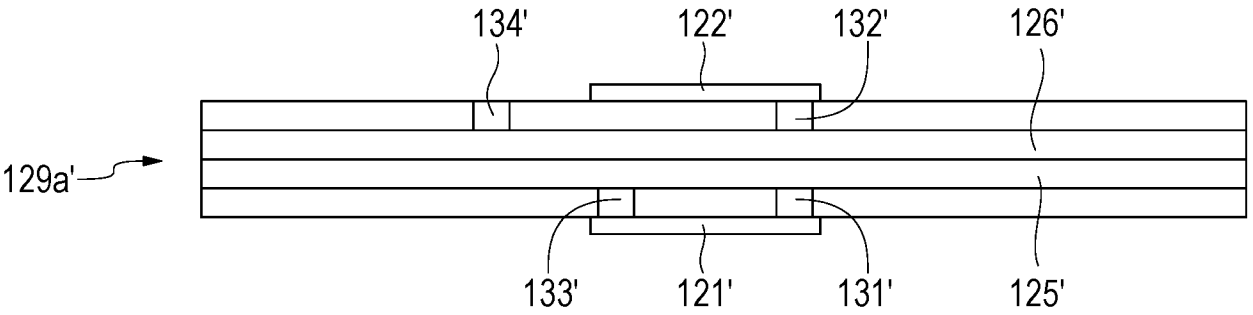
FIG. 14 is a schematic top view illustrating the first alignment position shown in FIG. 12.
Figure 15:
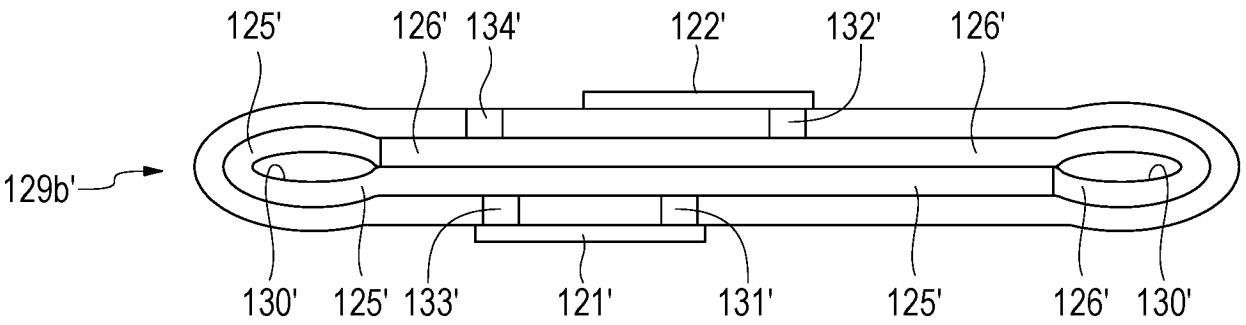
FIG. 15 is a schematic top view illustrating the second alignment position shown in FIG. 13.

The distal end 118' of the extension portion 117' includes the handles 121' and 122' and the fastening member 124', including the loop portion 125' and the hook portion 126', similar to the tool container assembly 100, and the two closed positions 129*a*' and 129*b*' are shown in FIGS. 12-15. Regarding the closure assembly, the easy opening position 129*a*' is shown in FIGS. 12 and 14, and the difficult opening position 129*b*' is shown in FIGS. 13 and 15. Preferably, the first and second indicators 131' and 132' are each a first colored tab, and the third and fourth indicators 133' and 134' are each a second colored tab. For example, the first colored tabs could be green, indicating the easy opening position 129*a*', and the second colored tabs could be red, indicating the difficult opening position 129*b*'.

In this embodiment, when the first and second indicators are at least partially aligned or overlapping, as shown in FIGS. 12 and 14, the ends of the first and second handles 121' and 122' are at least partially aligned or overlapping, including the handle attachments securing the ends of the handles to the distal end portion 118' (in this embodiment the box-X stitch patterns). It is preferred in this embodiment that the inner sides of the handle attachments relative to the handles are within 1.50 inches from one another, when positioned in either right or left positions relative to one another, in the easy opening position 129*a*'. When the corresponding handle attachments are placed proximate one another in this position, they generally create weakened portions in the fastening member 124' proximate where the user pulls on the handles 121' and 122', which allows the fastening member 124' to separate with reduced effort. In other words, this positions the fastening member 124' in an easy opening position 129*a*' because leverage using one's hands easily pulls the handles 121' and 122' apart thereby easily separating the loop and hook portions 125' and 126' of the fastening member 124'.

When the third and fourth indicators are at least partially aligned or overlapping, as shown in FIGS. 13 and 15, the first and second handles 121' and 122' are not at least partially aligned or overlapping. Although this arrangement is preferred in this embodiment, it is recognized that any arrangement where the inner sides of the handle attachments relative to the handles are greater than 1.50 inches from one another position the assembly in the difficult opening position 129*b*'. This positions the fastening member 124' in a difficult opening position 129*b*' because leverage using one's hands cannot pull the handles 121' and 122', and thereby the fastening member 124', apart. Rather, the user places her/his fingers in the gaps 130' formed between the opposing sides to force the loop and hook portions 125' and 126' of the fastening member 124' apart. These two different closed positions are beneficial during different circumstances. For example, during transit, it may be desirable to position the fastening member 124' in the difficult opening position 129*b*' to prevent accidental opening of the assembly resulting in spilling its contents and, during use, it may be desirable to position the fastening member 124' in the easy opening position 129*a*' to allow easy access to the contents while preventing spillage of the contents while performing tasks.

In other words, in the difficult opening position 129*b*', the fastening member 124' is difficult to separate, making it difficult to breach, which is particularly useful as the user lifts or travels with the container at elevation without the risk of spilling the items stored inside the container. In this position, the first and second indicators are separated, the handle attachments are not at least partially aligned or overlapping, and the fastening member 124' creates a stronger connection thereby making it difficult to open the closure system by simply using the handles, which are also not directly opposite one another, but are offset, relative to one another. This contributes to the difficulty of opening the closure system. The user is required to peel from the corners or ends of the closure system proximate the top in order to separate and open the closure. This provides a secure method for lifting and transporting the container while securing the contents inside.

Figure 17:
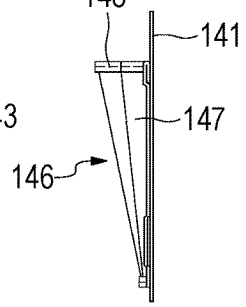
FIG. 17 is a side view of the optional insert shown in FIG. 16.
Figure 16:
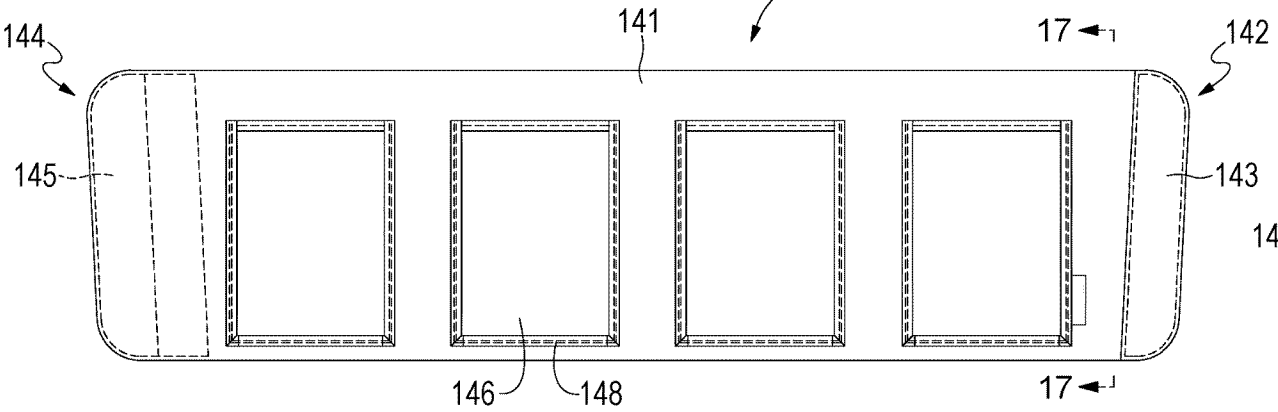
FIG. 16 is a plan view of an inside surface of an optional insert for use with a tool container assembly constructed in accordance with the principles of the present invention.
Figure 18:
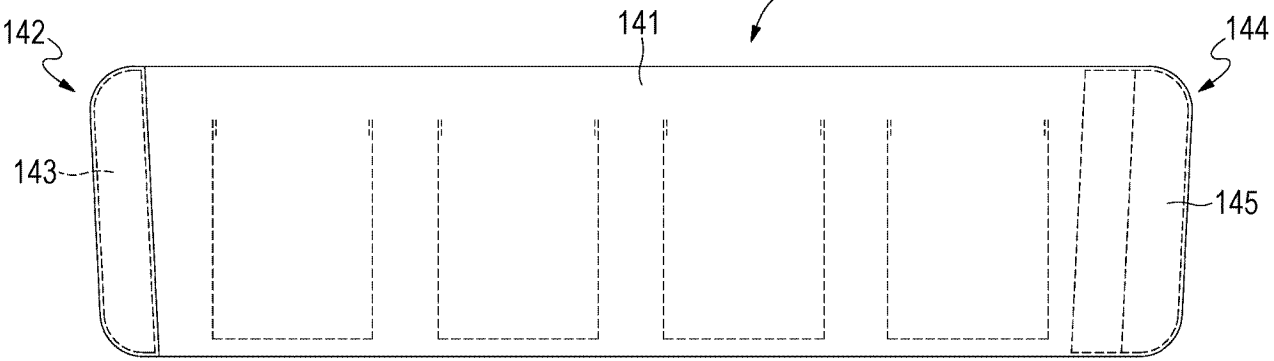
FIG. 18 is a plan view of an outside surface of the optional insert shown in FIG. 16.

As shown in FIGS. 16-18, an optional insert 140 could also be used with any of the embodiments. The insert 140 is configured and arranged to fit within the cavity 109 and includes a support member 141, which is preferably made of hardboard or any other suitable semi-rigid to rigid material. The support member 141 is generally rectangular in shape with a first end 142 to which a first fastener (e.g., hook portion) 143 is connected and a second end 144 to which a second fastener (e.g., loop portion) 145 is connected. Between the first and second ends 142 and 144, a plurality of pockets 146 made of nylon or other suitable material, are operatively connected. The plurality of pockets 146 could include gusset portions 147 and binder material 148. The plurality of pockets 146 could be positioned to either face inside or outside relative to the support member 141. The insert 140 allows for additional items to be organized within the body's cavity 109.

Figure 22:
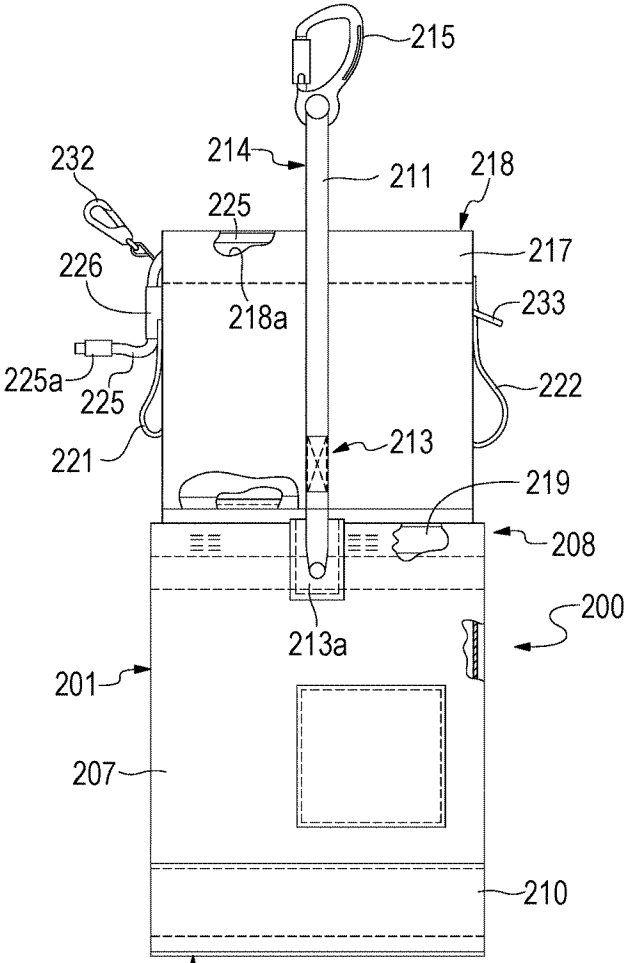
FIG. 22 is a side view of the tool container assembly shown in FIG. 21.
Figure 21:
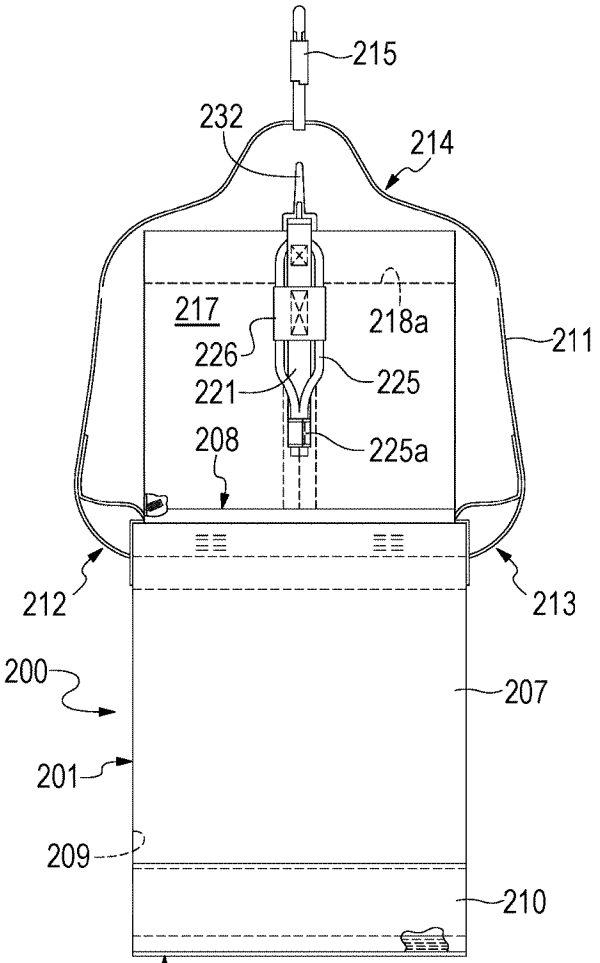
FIG. 21 is a front view of a tool container assembly constructed in accordance with the principles of the present invention.
Figure 26:
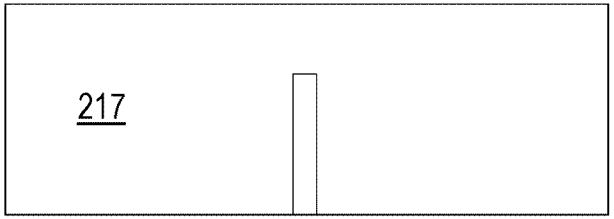
FIG. 26 is an inside surface of the extension portion shown in FIG. 24.
Figure 25:
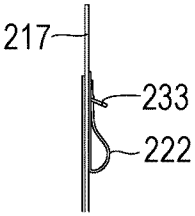
FIG. 25 is a side view of the extension portion shown in FIG. 24.
Figure 24:
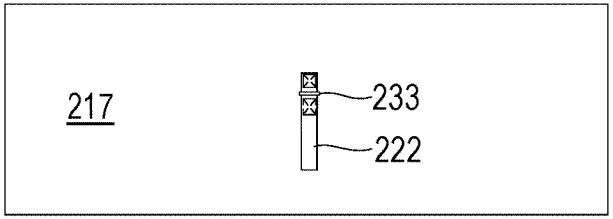
FIG. 24 is a plan view of an outside surface of an extension portion of the tool container assembly shown in FIG. 21.
Figure 29:
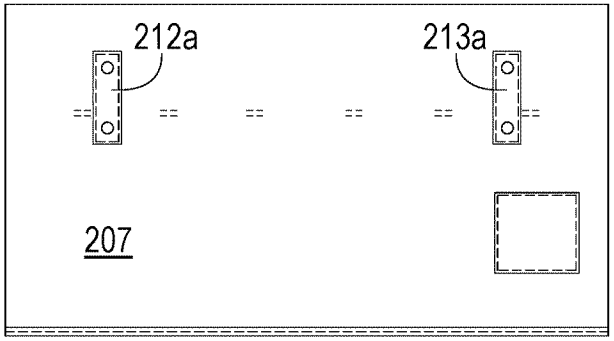
FIG. 29 is a plan view of an outside surface of the side shown in FIG. 27.

Another embodiment tool container assembly 200 is shown in FIGS. 21-22. Tool container assembly 200 includes a body 201 having a bottom 202, a side 207, and a top 208. The bottom 202, the side 207, and the top 208 form a cavity 209 accessible through an opening formed by the top 208. A rim 219 is operatively connected to the top 208 to assist in providing structure to the top 208 and its opening. An extension portion 217, which is a sleeve-like extension of the side 207, is operatively connected to the top 208 and includes a distal end portion 218, which in this embodiment is folded over onto itself and secured by stitching to form a channel 218*a*. A bottom support 210 could be used to interconnect the bottom 202 and the side 207 and could be used to add strength proximate the bottom of the assembly.

The bottom 202 could be similar to the bottom 102 and include several layers, and the bottom support 210 could include an inside layer and an outside layer. The side 207, the top 208, and the extension portion 217 could also be made of canvas. The rim 219 is preferably positioned in the top hem of the side 207, and could be any suitable material such as but not limited to molded plastic, nylon pipe material, steel, or wood approximately one inch wide, which makes the top of the container relatively stiff. It is recognized that fewer or more layers made of different materials could be used for any of these components in accordance with desired durability.

An elongate member 211 preferably made of webbing or rope includes an intermediate portion 214 interconnecting a first end 212 and a second end 213. Proximate one side of the side 207, a first reinforcing member 212*a* may be operatively connected to the side 207 proximate the top 208, and proximate an opposing side of the side 207, a second reinforcing member 213*a* may be operatively connected to the side 207 proximate the top 208. The reinforcing members 212*a* and 213*a* provide stronger areas to which the ends 212 and 213 are connected. For example, the reinforcing members 212*a* and 213*a* may be made of a stronger material, such as leather, and include apertures through which the respective ends 212 and 213 are inserted and then secured onto themselves, preferably by stitching or any other suitable securing member, forming loops through which the rim 219 extends. A connector 215, for example a carabiner, may be connected to the intermediate portion 214 to provide a way to connect the assembly to a hoist line, an anchorage structure, or the like.

As shown in FIG. 22, a first handle 221 is operatively connected to a first outer side of the distal end portion 218, and a second handle 222 is operatively connected to a second, generally opposing outer side of the distal end portion 218. The handles 221 and 222 or the elongate member 211 could be used to carry the assembly.

A fastening member 224 in this embodiment includes a drawstring 225, which is routed through the channel 218*a* through an opening providing access to the channel 218*a* proximate the first handle 221. The ends of the drawstring 225 extend outward through the opening and are operatively connected to the first handle 221 and the extension portion 217 via an engaging member 226. The engaging member 226 is a sleeve forming two channels through which the ends are routed, and the distal ends of the drawstring 225 are secured together with a stop member 225*a*. Stitching secures the engaging member 226 to the first handle 221 and the extension portion 217 between the two channels. The two channels are configured and arranged to provide friction on the drawstring 225 so that a desired amount of force is needed to move the drawstring 225 through the engaging member 226. The fastening member 224 also includes a locking member 231, which includes a hook member 232 and a ring member 233. The hook member 232 is operatively connected to the first handle 221, and the ring member 233 is operatively connected to the second handle 222.

Figure 30:
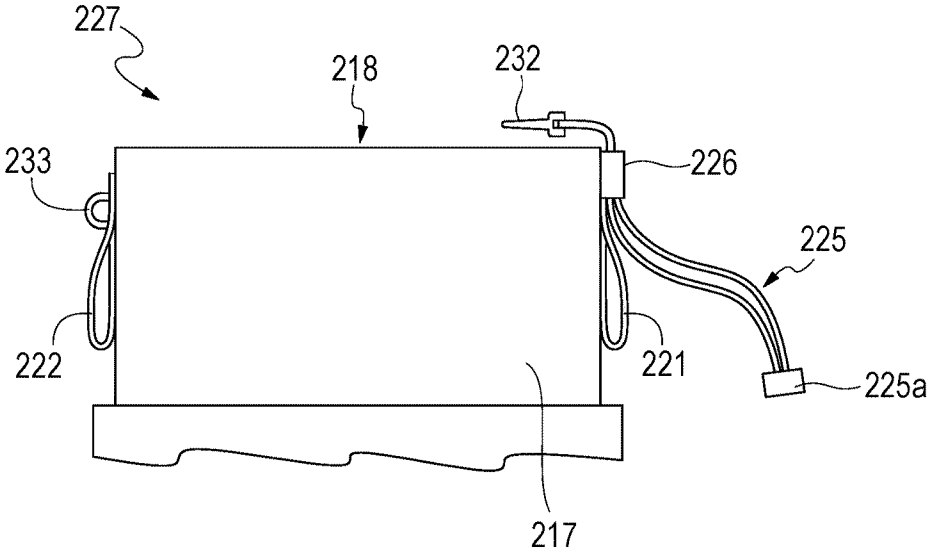
FIG. 30 is a schematic view of the extension portion in an open position of the tool container assembly shown in FIG. 21.

The fastening member 224 is used to position an opening 228 formed by the distal end portion 218 of the extension portion 217 between an open position 227, illustrated in FIG. 30, and a closed position. There are two closed positions, an easy opening position (not shown) and a difficult opening position 229*b*, illustrated in FIG. 31. In the open position, the opening provides access to the cavity 209. In the closed position, the opening is generally closed by the fastening member 224 thereby preventing access to the cavity 209.

Figure 31:
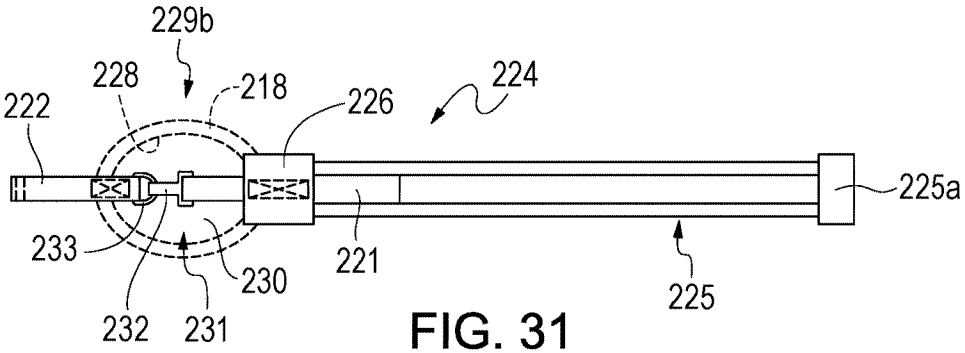
FIG. 31 is a schematic view of the extension portion in a difficult to open position of the tool container assembly shown in FIG. 21.

More specifically, in the closed positions, the drawstring 225 is pulled to reduce the amount of drawstring 225 within the channel 218*a* thereby gathering or cinching the top of the extension portion 217. Although the opening is significantly reduced in the closed positions, the reduced opening may form a relatively small gap 230. Friction between the engaging member 226 and the drawstring 225 assist in preventing the drawstring 225 from moving through the engaging member 226 with little to no force exerted upon the assembly. This is the easy opening position. To position the assembly in the difficult opening position 229*b*, the hook member 232 engages the ring member 233, as shown in FIG. 31. To position the extension portion 217 into the open position, To move the assembly from the difficult opening position 229*b* to the easy opening position, the hook member 232 is disconnected from the ring member 233. To move the assembly from the easy opening position to the open position 227, the user may either insert a finger from each hand proximate opposing sides of the gap 230 and pull, or the user may pull the handles 221 and 222 away from each other.

Figure 28:
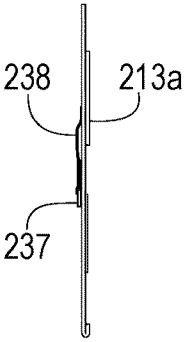
FIG. 28 is a side view of the side shown in FIG. 27.
Figure 27:
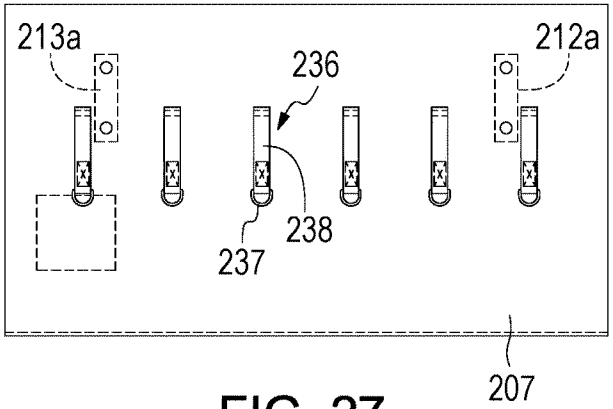
FIG. 27 is a plan view of an inside surface of a side of the tool container assembly shown in FIG. 21.

An optional attachment member 236 includes an engaging portion 237, which is preferably a ring or a hook to which any suitable tool lanyard may be connected, and a strap 238, which is preferably nylon webbing or an elastic material and interconnects the engaging portion 237 and the body 201, preferably the inside surface of the side 207. The attachment member 236 is shown in FIGS. 27 and 28.

Generally, the various features of the embodiments could be interchangeable, and the embodiments offer flexibility in materials depending upon desired style and durability. For example, the body of the tool container assembly could be made of a variety of materials, and examples of materials include canvas, duck canvas, vinyl, nylon, polyester, synthetic leather, leather, material with or without UV resistance, FR rated material, and material used for extreme weather. In addition, these materials could be any desired thickness and weight. Further, the bottom of the tool container assembly could include a hard-body material placed on top of the exterior material to add stiffness to the bottom and prevent puncture should a sharp or pointed object be thrown into the container. An interior material could be placed on top of the hard-body material to keep the hard-body material sandwiched between the exterior and interior materials. The exterior and interior materials could be any suitable material such as those listed for the body of the tool container assembly. Further, the elongate member, which is generally a lifting strap, is preferably a nylon webbing material but other suitable materials such as polyester webbing, cord, rope, leather, and other suitable materials could be used. The lifting strap is used to lift the assembly using the connector, which could be a hook, ring, or other suitable connector. The connector could be made of aluminum, steel, stainless steel, or other suitable material. The connector could be optional.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A tool container assembly, comprising:

a body having a bottom, a side, and a top providing access to a cavity formed by the bottom and the side;

an extension portion operatively connected to the top, the extension portion having a distal end portion;

a fastening member operatively connected to the distal end portion, the fastening member having a first portion and a second portion operatively connected to opposing sides of the distal end portion of the extension portion, the fastening member having an open position and a closed position, the open position forming an opening allowing access to the cavity, the closed position closing the opening thereby preventing access to the cavity, the closed position having an easy opening position and a difficult opening position; and at least one indicator positioned on one side and at least one indicator positioned on another side of the distal end portion, the indicators being at least partially aligned to position the extension portion in one of the easy opening position and the difficult opening position.

2. The tool container assembly of claim 1, further comprising an elongate member having first and second ends operatively connected to opposing sides of the top of the body.

3. The tool container assembly of claim 2, further comprising a connector operatively connected to an intermediate portion of the elongate member.

4. The tool container assembly of claim 1, further comprising an attachment member operatively connected to at least one of the side and the extension portion.

5. The tool container assembly of claim 4, wherein the attachment member includes a ring portion.

6. The tool container assembly of claim 5, wherein a strap interconnects the at least one of the side and the extension portion and the ring.

7. The tool container assembly of claim 6, wherein the strap is made of an elastic material.

8. The tool container assembly of claim 1, wherein the first portion includes a hook portion and the second portion includes a loop portion.

9. The tool container assembly of claim 1, wherein the at least one indicator positioned on one side of the distal end portion includes a first indicator and a third indicator and the at least one indicator positioned on another side of the distal end portion includes a second indicator and a fourth indicator, the first and second indicators being at least partially aligned to position the extension portion in the easy opening position, the third and fourth indicators being at least partially aligned to position the extension portion in the difficult opening position.

10. The tool container assembly of claim 9, wherein the first and second indicators are first colored tabs and the third and fourth indicators are second colored tabs.

11. The tool container assembly of claim 1, further comprising an insert configured and arranged to fit within the cavity, the insert being at least semi-rigid and including a plurality of pockets.

12. The tool container assembly of claim 1, further comprising a first handle and a second handle operatively connected to the opposing sides of the distal end portion of the extension portion, the first handle proximate the first portion and the second handle proximate the second portion, the first and second handles configured and arranged to position the fastening member in the open position when pulled in opposite directions.

13. The tool container assembly of claim 12, wherein the at least one indicator positioned on one side of the distal end portion includes a first indicator and a third indicator and the and at least one indicator positioned on another side of the distal end portion includes a second indicator and a fourth indicator, the first and second indicators being at least partially aligned to at least partially align the first and second handles and position the extension portion in the easy opening position, the third and fourth indicators being at least partially aligned to offset the first and second handles and position the extension portion in the difficult opening position.

14. A tool container assembly, comprising:

a body having a bottom, a side, and a top providing access to a cavity formed by the bottom and the side;

an extension portion operatively connected to the top, the extension portion having a distal end portion;

a fastening member operatively connected to the distal end portion, the fastening member having an open position and a closed position, the open position forming an opening allowing access to the cavity, the closed position closing the opening thereby preventing access to the cavity;

a first handle and a second handle, the first and second handles being operatively connected to the opposing sides of the distal end portion of the extension portion; and a first indicator, a second indicator, a third indicator, and a fourth indicator, the first and third indicators being positioned on one side and the second and fourth indicators being positioned on another side of the distal end portion, the first and second indicators being at least partially aligned to at least partially align the first and second handles and position the extension portion in an easy opening position, the third and fourth indicators being at least partially aligned to offset the first and second handles and position the extension portion in a difficult opening position.

15. The tool container assembly of claim 14, wherein the fastening member includes a hook portion and a loop portion, the hook portion and the loop portion being operatively connected to opposing sides of the distal end portion of the extension portion.

16. The tool container assembly of claim 14, wherein the first and second indicators are first colored tabs and the third and fourth indicators are second colored tabs.

17. A tool container assembly, comprising:

a body having a bottom, a side, and a top providing access to a cavity formed by the bottom and the side;

an extension portion operatively connected to the top, the extension portion having a distal end portion;

a fastening member operatively connected to the distal end portion, the fastening member having an open position and a closed position, the open position forming an opening allowing access to the cavity, the closed position closing the opening thereby preventing access to the cavity; and a first indicator, a second indicator, a third indicator, and a fourth indicator, the first and third indicators being positioned on one side and the second and fourth indicators being positioned on another side of the distal end portion, the first and second indicators being at least partially aligned to position the extension portion in an easy opening position, the third and fourth indicators being at least partially aligned to position the extension portion in a difficult opening position.

18. The tool container assembly of claim 17, further comprising:

a first handle and a second handle, the first and second handles being operatively connected to the opposing sides of the distal end portion of the extension portion; and the first and second indicators being at least partially aligned to at least partially align the first and second handles and position the extension portion in the easy opening position, the third and fourth indicators being at least partially aligned to offset the first and second handles and position the extension portion in the difficult opening position.

19. The tool container assembly of claim 17, wherein the fastening member includes a hook portion and a loop portion, the hook portion and the loop portion being operatively connected to opposing sides of the distal end portion of the extension portion.

* * * * *